US006394855B1

(12) United States Patent
Sorvino et al.

(10) Patent No.: US 6,394,855 B1
(45) Date of Patent: May 28, 2002

(54) IN-LINE MULTI-PLUG SELF-ALIGNING CONNECTOR

(75) Inventors: Alfred Sorvino; Christopher P. Owan, both of Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/680,795

(22) Filed: Oct. 6, 2000

(51) Int. Cl.[7] ..... H01R 13/64; H01R 13/28; H01R 25/00

(52) U.S. Cl. ..... 439/680; 439/290

(58) Field of Search ..... 439/680, 701, 439/686, 695, 284, 290

(56) References Cited

U.S. PATENT DOCUMENTS

| | | | | | |
|---|---|---|---|---|---|
| 3,394,337 | A | * | 7/1968 | Miller | 339/91 |
| 4,179,179 | A | * | 12/1979 | Lowden | 439/278 |
| 4,211,461 | A | * | 7/1980 | Wescott | 439/357 |
| 4,795,375 | A | * | 1/1989 | Williams | 439/680 |
| 4,830,621 | A | | 5/1989 | Maue et al. | |
| 4,867,699 | A | * | 9/1989 | Oda et al. | 439/355 |
| 4,990,099 | A | * | 2/1991 | Marin et al. | 439/171 |
| 5,211,585 | A | * | 5/1993 | Douty et al. | 439/680 |
| 5,306,171 | A | * | 4/1994 | Marshall | 439/284 |
| 5,575,674 | A | * | 11/1996 | Davis et al. | 439/284 |
| 5,613,881 | A | * | 3/1997 | Ichida et al. | 439/680 |
| 5,800,196 | A | * | 9/1998 | Rudoy et al. | 439/284 |
| 5,857,867 | A | * | 1/1999 | Henry | 439/290 |
| 6,007,362 | A | | 12/1999 | Davis et al. | |
| 6,220,891 | B1 | * | 4/2001 | Hills | 439/284 |
| 6,257,923 | B1 | * | 7/2001 | Stone et al. | 439/502 |

* cited by examiner

*Primary Examiner*—P. Austin Bradley
*Assistant Examiner*—Edwin A. León
(74) *Attorney, Agent, or Firm*—Renner, Otto, Boisselle & Sklar, LLP

(57) ABSTRACT

An in-line multi-plug self-aligning electrical connector assembly includes a receptacle, and a pair of connectors that matingly engage the receptacle. The receptacle has an alignment feature on a mating face of an end of the receptacle which mates with mates with the connectors. In an exemplary embodiment, the alignment feature is a wedge-shaped protrusion which corresponds in cross-sectional shape to one of the connectors. The receptacle may be cylindrical, and the connectors may be complimentary such that when engaging the receptacle they together form a cylindrical shape. The connectors may be coupled to different components. In an exemplary embodiment one of the connectors is electrically connected to a motor of a missile fin actuator and the other of the connectors is electrically connected to a potentiometer of the actuator.

22 Claims, 4 Drawing Sheets

IN-LINE MULTI-PLUG SELF-ALIGNING CONNECTOR

FIELD OF THE INVENTION

The invention relates to the field of electrical connectors.

BACKGROUND OF THE INVENTION

It is well known that a great variety of electrical connecters are used for electrical connection in a wide variety of circumstances. It will be appreciated that significant cost and/or effort may be involved in making and/or breaking electrical connection between components.

For example, in conventional practice, in order to electrically connect all motors and potentiometers in a missile control actuation unit all wires are dressed and then individually soldered manually to their respective contact points during assembly. If there are four motors and four potentiometers to be connected in this manner, then there are over 64 soldering connections which must be made. Since missiles are critical components of our nation's air weapon systems, they require high reliability and high manufacturing tolerances. Individual manual soldering of these connections may be low in reliability, may be labor and inspection intensive, and may be costly.

One shortcoming of this conventional solder-based design is that the number of individual solders makes it difficult to trouble shoot the actuation unit in order to determine which connection is causing the problem. Additionally, the solder-based design makes it difficult to easily exchange or service a faulty motor or potentiometer in a missile control actuation unit. Further, the solder-based design makes it very difficult to service a motor or potentiometer in the field. In fact, the current practice is to ship the entire missile to a depot. From the depot, the missile is shipped to the manufacture for servicing the faulty motor or potentiometer.

Another shortcoming of this conventional solder-based design is that each time a newly designed actuation unit is to be tested all the connections have to be broken to disconnect the old components of the actuation unit and then new solder broken to disconnect the old components of the actuation unit and then new solder connections must be made to connect the components of the new actuation unit.

The number of connections required makes this process labor and inspection intensive, thus increasing costs.

Yet another shortcoming of this conventional solder-based design is that it makes it difficult to test the electrical connections to the motors and potentiometers of assembled actuator units. This testing is required before delivery to a customer.

As a consequence, a need exists for improvement in electrically coupling the components of a missile control actuation unit in order to reduce the cost associated with using, manufacturing, testing and servicing the missile control actuation unit components and thereby eliminate costly corrective measures required to be taken as a result thereof.

It will be understood from the foregoing example that a general need exists for improved means of electrically connecting components.

SUMMARY OF THE INVENTION

An in-line multi-plug self-aligning electrical connector assembly includes a receptacle, and a pair of connectors that matingly engage the receptacle. The receptacle has an alignment feature on a mating face of an end of the receptacle which mates with mates with the connectors. In an exemplary embodiment, the alignment feature is a wedge-shaped protrusion which corresponds in cross-sectional shape to one of the connectors. The receptacle may be cylindrical, and the connectors may be complimentary such that when engaging the receptacle they together form a cylindrical shape. The connectors may be coupled to different components. In an exemplary embodiment one of the connectors is electrically connected to a motor of a missile fin actuator and the other of the connectors is electrically connected to a potentiometer of the actuator.

According to an aspect of the invention, an electrical connector includes a receptacle having an end with an alignment feature thereupon, and a pair of connectors which matingly engage the end.

According to another aspect of the invention, an electrical connector includes a receptacle and a pair of connectors which matingly engage the receptacle, the connectors being operatively configured to electrically couple respective components to the receptacle.

According to yet another aspect of the invention, a missile control actuation unit includes a motor, a motor connector electrically coupled to the motor, a potentiometer, a potentiometer connector electrically coupled to the motor, and a receptacle for matingly engaging the connectors.

According to still another aspect of the invention, a missile control actuation unit includes a motor, a motor connector electrically coupled to the motor, a potentiometer, and a potentiometer connector electrically coupled to the motor. The motor connector and the potentiometer connection are complimentary, that is they fit together. According to a specific embodiment of the invention, the connectors combine to form a cylindrical shape when fit together.

According to a further aspect of the invention, an electrical connector assembly includes a wedge-shaped connector which fits into a wedge-shaped recess in another connector.

According to another aspect of the invention, an electrical connector assembly includes a receptacle and a pair of connectors operatively configured to matingly engage an end of the receptacle, wherein the end has a recess or protrusion, and one of the connectors has a mating surface having a shape which corresponds to a shape of the recess or protrusion.

According to another aspect of the invention, a missile fin actuator includes a motor operatively configured to couple to a fin; a potentiometer operatively configured to couple to the fin; and an electrical connector assembly which includes a receptacle and a pair of connectors operatively configured to matingly engage an end of the receptacle, the connectors electrically coupled to the motor and the potentiometer. The end has a recess or protrusion, and one of the connectors has a mating surface having a shape which corresponds to a shape of the recess or protrusion. The pair of connectors includes a motor connector coupled to the motor and a potentiometer connector coupled to the potentiometer.

According to yet another aspect of the invention, an electrical connector assembly includes a receptacle and a pair of connectors operatively configured to matingly engage an end of the receptacle, wherein the end of the receptacle has an alignment means thereupon for properly aligning the connectors relative to the receptacle.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE PRESENT INVENTION

An in-line multi-plug self-aligning electrical connector assembly includes a receptacle with an alignment feature, such as a wedge-shaped protrusion. Two or more connectors matingly engage the receptacle, with the alignment feature used to properly align the connectors for proper engagement with the receptacle. The connectors may be coupled to different components. In the exemplary embodiment described in detail below, one of the connectors is electrically connected to a motor of a missile fin actuator and the other of the connectors is electrically connected to a potentiometer of the actuator. However, it will be appreciated that electrical connectors of the sort described herein may be used to electrically couple together various types of components in a wide variety of different configurations and applications.

Figure 1:
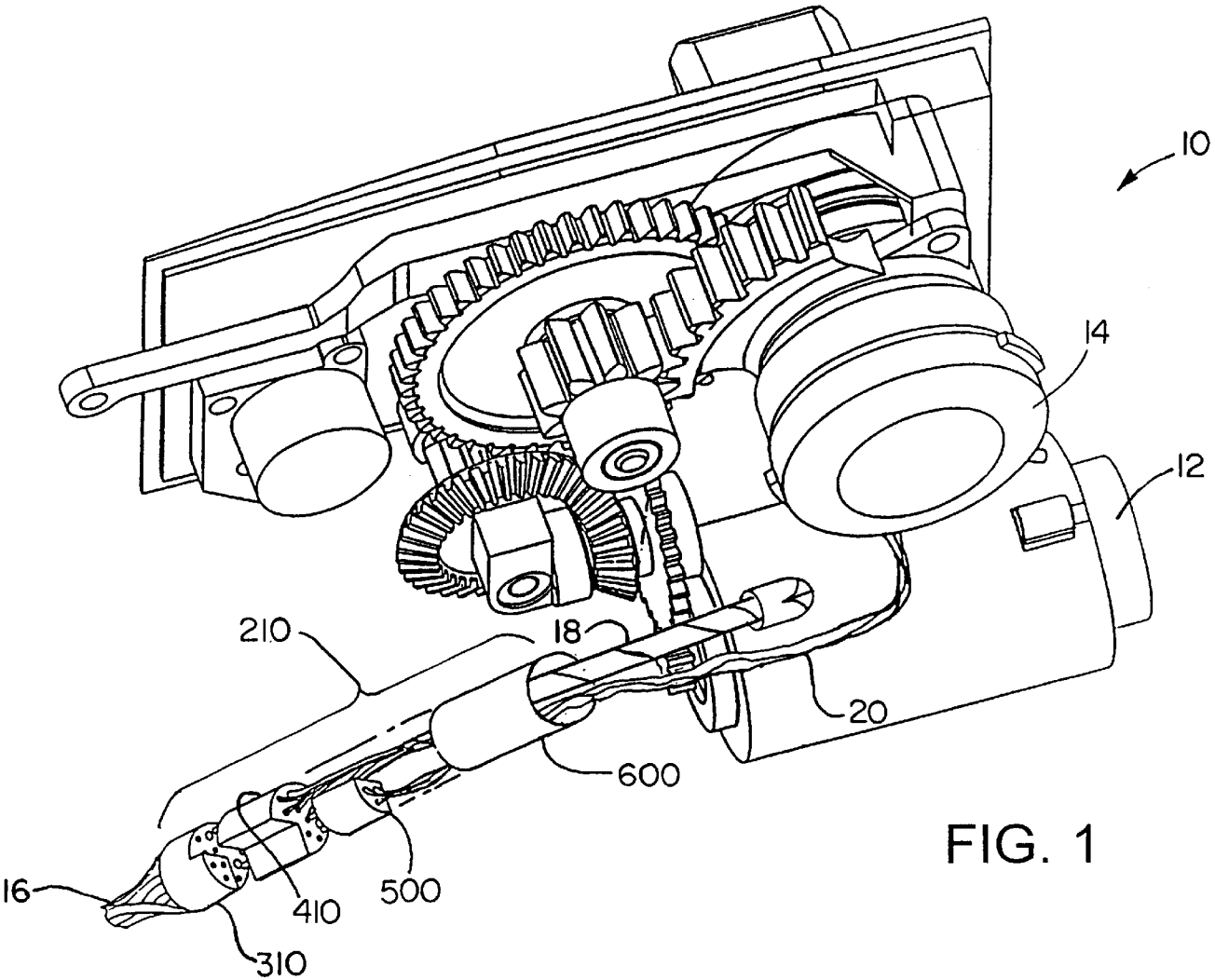
FIG. 1 is a perspective view of a single actuator subsystem of a missile control actuation unit of a missile, including a motor and a potentiometer that are electrically coupled to provide input in order to maneuver the missile, illustrating an in-line self-aligned multi-plug connector of the present invention.

Referring initially to FIG. 1, illustrated is a single actuator subsystem 10 of a missile control actuation unit of a missile. The actuator subsystem 10 includes a motor 12 and a potentiometer 14. The motor 12 and the potentiometer 14 are electrically coupled to an in-line self-aligned multi-plug connector 210 (also referred to as an electrical connector or electrical connector assembly), which is shown in exploded view. The in-line self-aligned multi-plug connector 210 includes a receptacle 300, a motor connector 400, a potentiometer connector 500, and a shrink tube 600, each of which is discussed in greater detail below.

A base wire harness 16 carries a plurality of wires or other electrical conductors, and is electrically coupled to the receptacle 300. The motor connector 400, when connected to the receptacle 300, electrically couples a portion of the wires of the base wire harness 16 to the motor 12, through a motor wire harness 18. Similarly, the potentiometer connector 500, when connected to the receptacle 300, electrically couples a portion of the wires of the base wire harness 16 to the potentiometer 14, through a potentiometer wire harness 20. The shrink tube 610 is metallized, thus providing a conductive path from one side to the other of the in-line self-aligned multi-plug connector 210.

Figure 3:
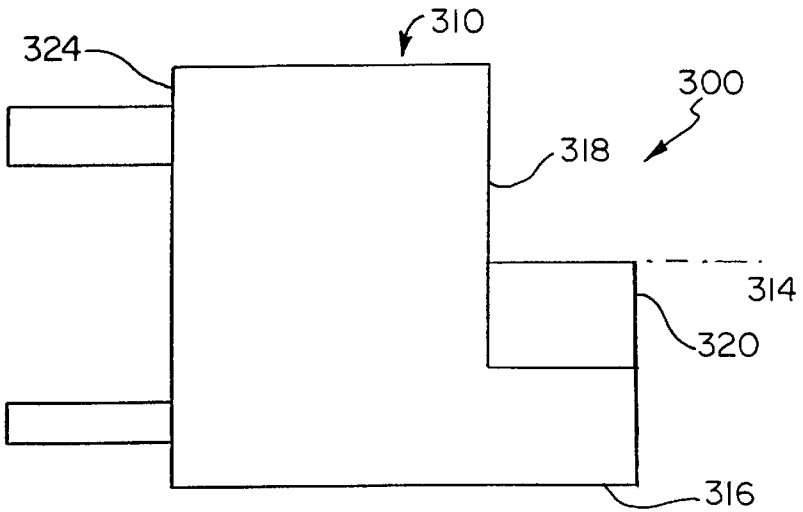
FIG. 3 is a side view of the receptacle of FIG. 2.
Figure 4:
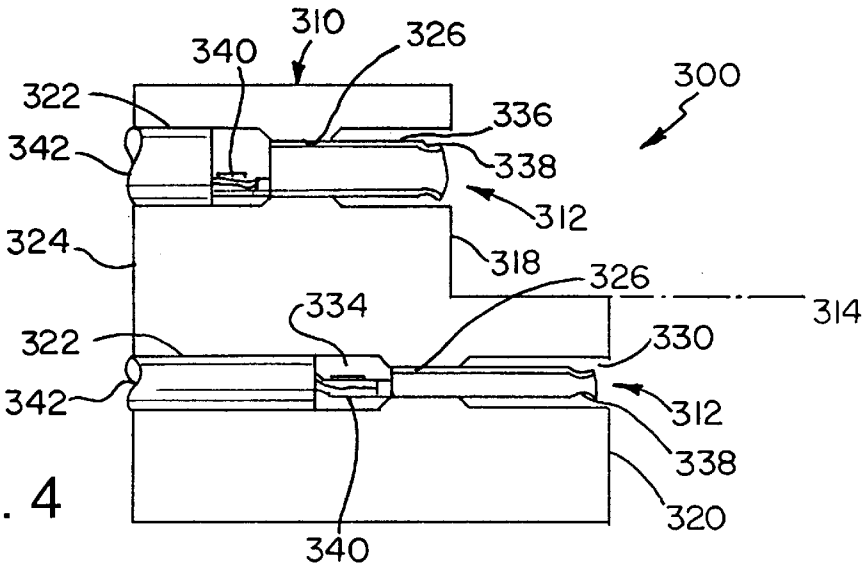
FIG. 4 is an end view of the receptacle of FIG. 2.
Figure 2:
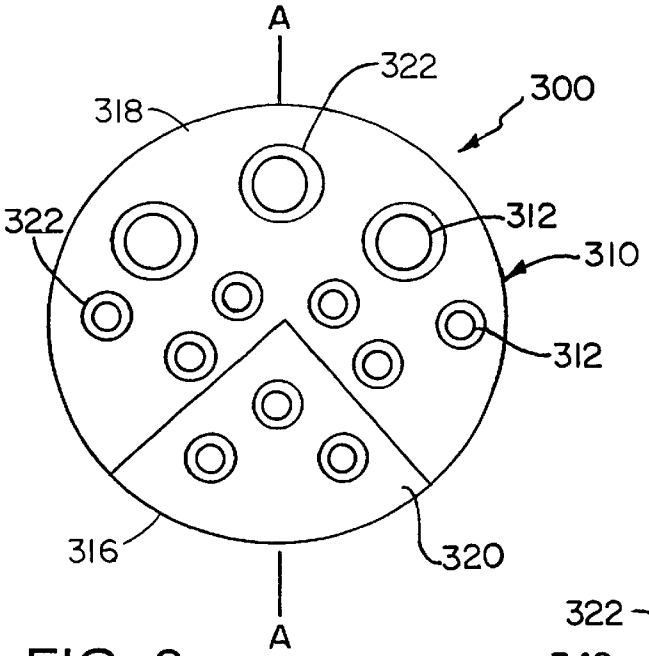
FIG. 2 is a top view of a receptacle of the multi-plug connector of FIG. 1.

Referring now to FIGS. 2–4, the receptacle 300 includes a receptacle body 310, and conductive female receptacle contact members 312 situated within the receptacle body. The receptacle body 310 is molded of an insulative material and has a substantially cylindrical shape which defines a longitudinal axis 314. The receptacle body includes a protruding portion such as a wedge-shape protruding portion 316 extending forwardly from a receptacle front mating wall 318. The front mating wall 318 defines an arc greater than the arc of the forward wedge-shape portion 316. The wedge-shape portion 316 has a protruding front mating wall 320.

The receptacle body 310 has a plurality of contact-receiving bores 322 extending longitudinally therethrough from a rear wall 324 to the front mating walls 318 and 320. Each of the contact-receiving bores 322 includes a central reduced diameter portion 326 bounded by an enlarged diameter forward portion 330 and an enlarged diameter rear portion 334.

Each of the female receptacle contact members 312 is stamped and formed from conductive sheet stock, and has a cylindrical barrel section 336 and a forward mating end 338. The forward mating end 338 is formed so as to surround and engage a mating male contact in a conventional manner, as described further below. The forward mating ends 338 are recessed within the bores 322, behind the appropriate front mating wall 318 or 320 of the bore. Rearwardly of the barrel section 336 is a crimp section 340 for attaching the conductive wire, or wires, 342, as is conventional. When the contact members 312 are installed in their respective bores 322, the barrel sections 336 are passed through the central reduced diameter portions 326 and enter the enlarged diameter forward portions 330. The contact members 312 are thus captured in the bores 322.

Some of the contact members 312 have a larger diameter than other of the contact members, as best seen in FIG. 2. It will be appreciated that alternatively all of the same contact members 312 may have the same diameter, if so desired.

Figure 6:
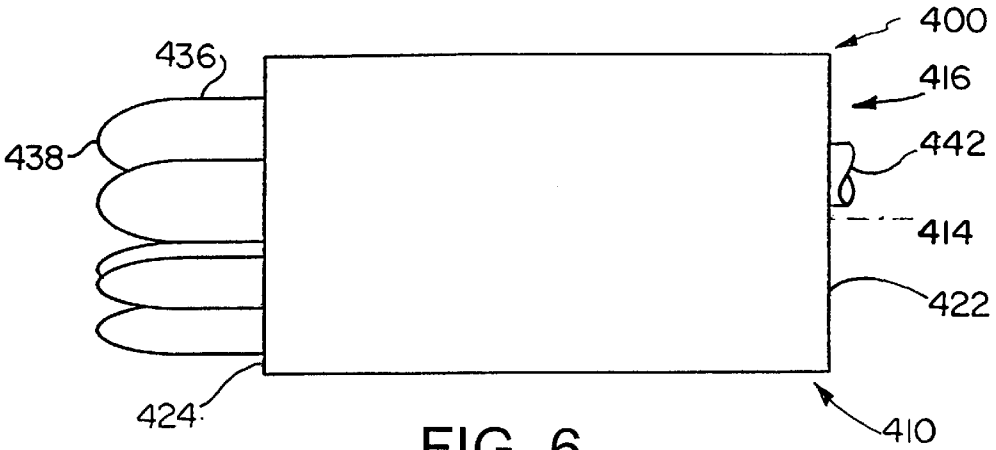
FIG. 6 is a side view of the motor connector of FIG. 5.
Figure 5:
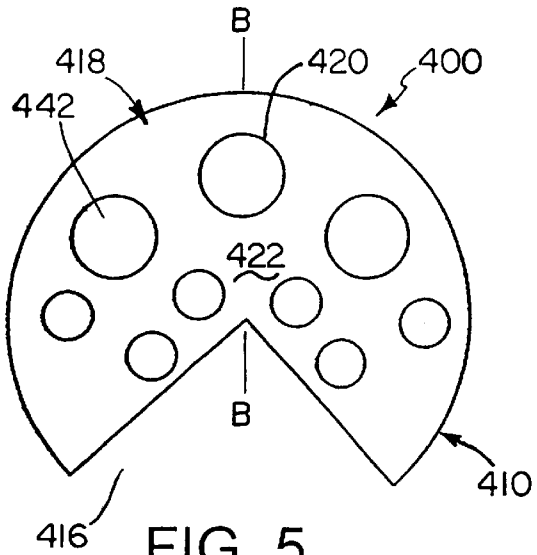
FIG. 5 is a top view of a motor connector of the multi-plug connector of FIG. 1.
Figure 7:
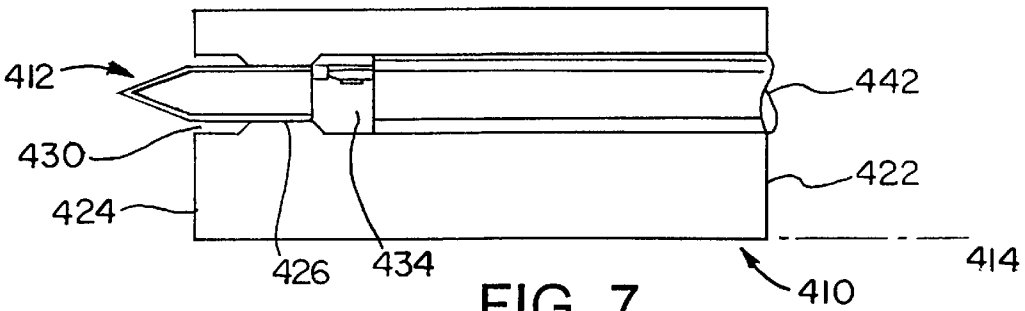
FIG. 7 is an end view of the motor connector of FIG. 5.

As shown in FIGS. 5–7, the motor connector 400 includes a motor connector body 410 and male contact members 412 held in place by the motor connector body.

The motor connector body 410 defines a longitudinal axis 414 and is molded of an insulative material. The motor connector body 410 subtends an arc greater than 180° and less than 360°, so that there is a wedge shape gap 416 in the motor connector body 410, as best seen in FIG. 5. The shape of the gap 416 corresponds to that of the wedge-shape protruding portion 316.

The motor connector body 410 has a plurality of contact receiving bores 420 which extend longitudinally from a rear wall 422 to a front mating wall 424. Each of the contact receiving bores 420 includes a central reduced diameter portion 426 which is bounded by an enlarged-diameter forward portion 430 and an enlarged-diameter rear portion 434.

Each of the male contact members 412 is stamped and formed from conductive sheet stock to have a cylindrical barrel section 436 and a forward mating end 438. The forward mating end 438 is formed so as to penetrate and engage the forward mating end 338 of a respective of the female contact members 312 of the 25 receptacle 300, as is conventional. The forward mating end extends beyond the front mating wall 424. Rearwardly of the barrel section 436 is a crimp section 440 for attaching a conductive wire or wires, 442, as is conventional. When a contact member 412 is installed in a contact receiving bore 420 the barrel section 436 is passed through the central reduced diameter portion 426 and enters the enlarged diameter forward portion 430 and is thus captured in the bore 420.

Figure 9:
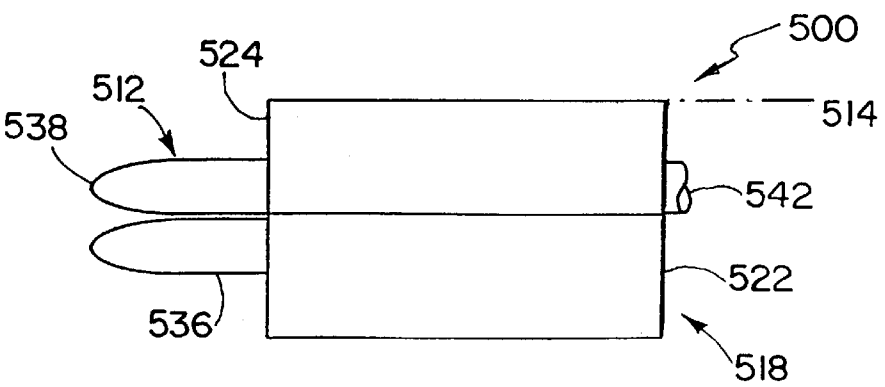
FIG. 9 is a side view of the potentiometer connector of FIG. 8.
Figure 10:
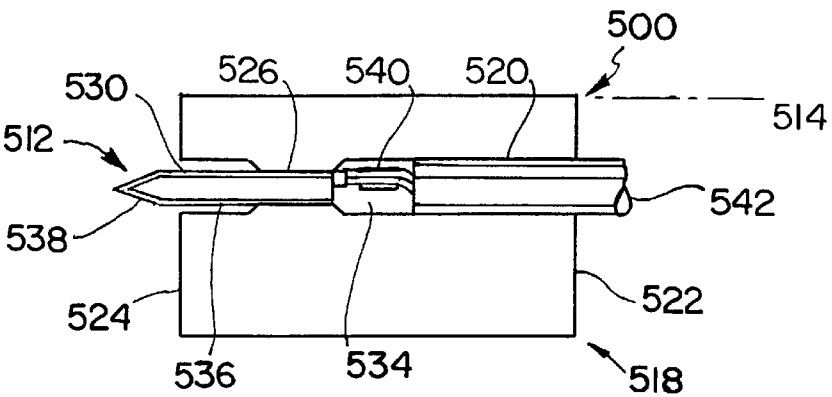
FIG. 10 is an end view of the potentiometer connector of FIG. 8.
Figure 8:
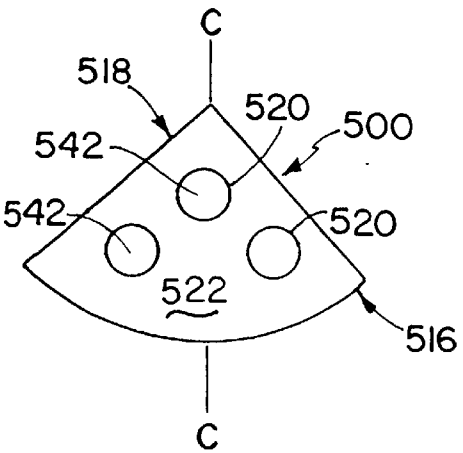
FIG. 8 is a top view of a potentiometer connector of the multi-plug connector of FIG. 1.

As shown in FIGS. 8–10, the potentiometer connector 500 includes a potentiometer connector body 510 and male contact members 512 within the potentiometer connector body.

The potentiometer connector body 510 has a wedge shape which is complemental to and fits within the wedge shape gap 416 of the motor connector body 410. The cross-sectional shape of the potentiometer connector body 510 therefore also has the same shape as the cross-sectional shape of the wedge-shape protruding portion 316. The point of the wedge shape defines a longitudinal axis 514, the wedge shape subtending an arc greater than 0° and less than 180° about the longitudinal axis.

In a specific embodiment the motor connector body 410 subtends an arc of approximately 45° and the potentiometer connector body 510 subtends an arc of approximately 315°, although it will be appreciated that other values may be used instead.

The potentiometer connector body 510 has a plurality of contact-receiving bores 520 which extend longitudinally through the potentiometer connector body from a rear wall 522 to a front mating wall 524. Each of the contact receiving bores 520 includes a central reduced diameter portion 526 which is bounded by an enlarged-diameter forward portion 530 and an enlarged-diameter rear portion 534.

Each of the male contact members 512 is stamped and formed from conductive sheet stock to have a cylindrical barrel section 536 and a forward mating end 538. The forward mating end 538 is formed so as to penetrate and engage the forward mating end 338 of a respective female contact member 312, as is conventional, and extends beyond the front mating wall 524 of its respective bore 520. Rearwardly of the barrel section 536 is a crimp section 540 for attaching the conductive wire, or wires, 542, as is conventional. When a contact member 512 is installed in a contact receiving bore 520 the barrel section 536 is passed through the central reduced diameter portion 526 and enters the enlarged diameter forward portion 530 and is thus captured in the bore 520.

The potentiometer connector body 510, like the receptacle body 310 and the motor connector body 410, is made of an insulative material, such as a molded insulative plastic. It will be appreciated that alternatively one or more of the bodies 310, 410, and 510, may be made of another suitable insulative material. Further, it will be appreciated that other suitable means may alternatively employed to secure the conductors 312, 412, and 512, into their respective bodies 310, 410, and 510. For instance, the conductors may be held in place while the body is overmolded around them.

To matingly engage the receptacle 300 and the motor connector 400, the forward wedge shape portion 316 extending forwardly from the front mating wall 318 of the receptacle body 310 is first aligned with the wedge shape gap 416,of the motor connector body 410. The complemental shapes of the forward wedge shape portion 316 and the wedge shape gap 416 provide a polarizing feature for proper mating of the receptacle 300 with the motor connector 400. The complemental shapes insure alignment of the contact receiving bores 322 in the receptacle body 310 with the contact receiving bores 420 in the motor connector body 410 prior to the mating of the corresponding contact members 312 and 412. Moving the receptacle 300 towards the motor connector 400 until the front mating wall 318 and 418 contact each other causes mating engagement of the contact members 312 and 412.

Since the motor connector body 410 is substantially longer than the forward wedge shape portion 316 of receptacle body 310, when fully inserted in receptacle 25 body 310, the motor connector body 410 exposes a portion of wedge shape gap 416 even when fully inserted in the receptacle body. This exposed portion of the wedge shape gap 416 allows alignment of the potentiometer connector 500 within the gap. The complemental shapes of the wedge shape gap 416 and the wedge shape 516 thus provide a polarizing feature for the mating of the forward wedge shape portion 316 of the receptacle body 310 with the potentiometer connector body 510. The complemental shapes insure alignment of the contact receiving bores 322 in the receptacle body 310 with the contact receiving bores 520 in the potentiometer connector body 510 prior to the corresponding contact members 312 and 512 mating with each other. Moving the potentiometer connector 500 toward the receptacle body 300, within the gap 416, until the front mating walls 320 and 524 contact one another causes engagement of contact members 312 and 512.

The shrink tube 610 may be placed over the motor connector 400 and the potentiometer connector 500 prior to the mating of the connectors with the receptacle 300. After the mating of the connectors 400 and 500 with the receptacle 300, the shrink tube 610 is slid over the mated connectors and receptacle. Upon heating, the shrink tube 610 contracts, securing the mating of the connectors 400 and 500 to the receptacle 300.

As shown in FIG. 1, forward wedge shape portion 316 extends forwardly of face 318 a substantial distance and motor connector body 410 extends a substantial distance beyond forward wedge shape portion 316 when fully inserted in first body 300. These features provide a number of advantages. For example, the forward wedge shape portion 316 can be rotated within the wedge shape gap 416 of motor connector body 410, before the mating of the corresponding contact members 312 and 412. Thus it is advantageous for the protrusion of the forward wedge shape portion 316 beyond the front mating wall 318 to be equal to or greater than the protrusion of the contacts 412 beyond the front wall 424 of the motor connector 400.

Further, the wedge shape portion 516 of potentiometer connector body 510 can be rotated or otherwise moved within the exposed wedge shape gap 416 of motor connector body 410 before the corresponding contact members 312 and 512 are mated to each other. Thus, the bodies 410 and 510 may be properly aligned or positioned before the mating of the potentiometer connector 500 and the receptacle 300. This aids an installer, especially one who may have difficulty with handling and seeing the subassemblies at the same time because they are obstructed from view. Also, such partial alignment or positioning before polarization prevents damage to the contact members 312 and 512.

It will be well understood that many variants on the above-described multiplug connector 210 are possible. For example, it will be appreciated that the wedge-shaped protrusion 316 may alternatively have a variety of other shapes, and/or may be a recess instead of a protrusion.

Further, it will be appreciated that the receptacle 300 may alternatively have male contacts, or a combination of male and female contacts, with the connectors 400 and 500 having corresponding mating contacts. For example, the receptacle may have female contacts to mate with male contacts of the motor connector 400, and may have male contacts to mate with female contacts of the potentiometer connector 500. Such an arrangement may itself act as a self-aligning feature. It will be appreciated that alternatively or in addition the contacts of the motor connector 400 may be a different size and/or shape, for example a different diameter, than the contacts of the potentiometer connector 500. The number and/or arrangement of contacts may alternatively be other than as shown.

It will be appreciated that a wide variety of suitable mating contacts may be substituted for the contacts shown in the figures and described above.

It will also be appreciated that the overall shape of the multi-plug connector 210 may be other than cylindrical, with a nonaxisymmetric shape perhaps being utilized as part of a self-aligning feature. Alternatively or in addition, the component connectors 400 and 500 may have complimentary shapes such that one fits in side the other.

It will further be appreciated that a variety of multi-plug electrical connector assemblies may be created with various numbers, sizes, and shapes of receptacle and connector parts. Such connector assemblies may be used to electrically couple together a wide variety of components.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electrical connector assembly comprising:

an electrical receptacle and a pair of discrete, separable electrical connectors operatively configured to matingly engage an end of the receptacle, wherein the end has a recess or protrusion, and one of the connectors has a mating surface having a shape which corresponds to a shape of the recess or protrusion;

wherein the recess or protrusion has a wedge shaped cross section; and wherein the one of the connectors has a cross sectional shape which is substantially the same as the wedge shape.

2. The connector assembly of claim 1, wherein the recess or protrusion has a flat mating wall which butts against the mating surface of the one of the connectors.

3. The connector assembly of claim 1, wherein the receptacle has a receptacle body with receptacle contact members therein, and wherein the connectors each have connector contact members which matingly engage the receptacle contact members.

4. The connector assembly of claim 3, wherein the receptacle contact members are female contact members and the connector contact members are male contact members.

5. The connector assembly of claim 3, wherein the connector contact members of one of the connectors have a different size than at least some of the contact members of the other of the connectors.

6. The connector assembly of claim 1, wherein the receptacle has a circular cross section.

7. The connector assembly of claim 6, wherein the recess or protrusion subtends an arc of approximately 45°.

8. The connector assembly of claim 6, further comprising a shrink tube which surrounds the receptacle and the connectors.

9. The connector assembly of claim 8, wherein the shrink tube is metallized.

10. An electrical connector assembly comprising:

an electrical receptacle and a pair of discrete, separable electrical connectors operatively configured to matingly engage an end of the receptacle, wherein the end has a recess or protrusion, and one of the connectors has a mating surface having a shape which corresponds to a shape of the recess or protrusion;

wherein the receptacle has a circular cross section; and wherein the connectors have complimentary shapes such that one of the connectors fits into the other of thee connectors.

11. The connector assembly of claim 10, wherein the connectors have complimentary shapes such that one of the connectors fits into a gap in the other of the connectors.

12. The connector assembly of claim 10, wherein the receptacle has a receptacle body with receptacle contact members therein, and wherein the connectors each have connector contact members which matingly engage the receptacle contact members.

13. The connector assembly of claim 10, wherein the connectors, when matingly engaged with the receptacle, combine to have a substantially circular cross section.

14. The connector assembly of claim 10, further comprising a shrink tube which surrounds the receptacle and the connectors.

15. The connector assembly of claim 14, wherein the shrink tube is metallized.

16. An electrical connector assembly comprising:

an electrical receptacle and a pair of discrete, separable electrical connectors operatively configured to matingly engage an end of the receptacle, wherein the end has a recess or protrusion, and one of the connectors has a mating surface having a shape which corresponds to a shape of the recess or protrusion;

a shrink tube which encircles the receptacle and the connectors and which secures the receptacle and the connectors in mating engagement; and wherein the connectors have complimentary shapes such that one of the connectors fits into a gap in the other of the connectors.

17. An electrical connector assembly of comprising:

an electrical receptacle and a pair of discrete, separable electrical connectors operatively configured to matingly engage an end of the receptacle, wherein the end of the receptacle has an alignment means thereupon for properly aligning the connectors relative to the receptacle; and wherein the connectors have complimentary shapes such that one of the connectors fits into. a gap in the other of the connectors.

18. The connector assembly of claim 16, wherein the receptacle has a receptacle body with receptacle contact members therein, and wherein the connectors each have connector contact members which matingly engage the receptacle contact members.

19. The connector assembly of claim 16, wherein the shrink tube is metallized.

20. The connector assembly of claim 17, wherein the alignment means is a protruding portion protruding from the end.

21. The connector assembly of claim 20, wherein the protruding portion protrudes from the end in a direction along an axis of the receptacle.

22. The connector assembly of claim 21, wherein the protruding portion is wedge shaped.

* * * * *